US009425015B2

(12) United States Patent
Sandoval Camacho et al.

(10) Patent No.: US 9,425,015 B2
(45) Date of Patent: Aug. 23, 2016

(54) MAGNETIC TRIP DEVICE OF A THERMAL MAGNETIC CIRCUIT BREAKER HAVING A STABILIZER ELEMENT

(71) Applicant: Siemens Aktiengesellschaft, Munich (DE)

(72) Inventors: Esteban Sandoval Camacho, Monterrey (MX); Stephen Scott Thomas, Atlanta, GA (US)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 14/559,039

(22) Filed: Dec. 3, 2014

(65) Prior Publication Data

US 2015/0243466 A1 Aug. 27, 2015

(30) Foreign Application Priority Data

Feb. 25, 2014 (EP) ..... 14156607

(51) Int. Cl.

| | |
|---|---|
| ***H01H 81/00*** | (2006.01) |
| ***H01H 83/00*** | (2006.01) |
| ***H01H 75/12*** | (2006.01) |
| ***H01H 77/00*** | (2006.01) |
| ***H01H 71/74*** | (2006.01) |
| *H01H 71/40* | (2006.01) |

(52) U.S. Cl.

CPC ..... *H01H 71/7463* (2013.01); *H01H 71/405* (2013.01); *H01H 71/40* (2013.01)

(58) Field of Classification Search

CPC . H01H 71/405; H01H 71/7463; H01H 71/40
See application file for complete search history.

(56) References Cited

U.S. PATENT DOCUMENTS

| | | | | |
|---|---|---|---|---|
| 2,937,252 | A | 5/1960 | Strother et al. | |
| 3,319,195 | A * | 5/1967 | Strobel et al. | 335/36 |
| 2015/0035627 | A1* | 2/2015 | Sandoval Camacho et al. | 335/1 |
| 2015/0206688 | A1* | 7/2015 | Cantu Gonzalez | 335/35 |
| 2015/0228433 | A1* | 8/2015 | Carrillo Soto et al. | 335/43 |
| 2015/0243465 | A1* | 8/2015 | Thomas et al. | 335/35 |

FOREIGN PATENT DOCUMENTS

| | | | |
|---|---|---|---|
| WO | WO-2013/126061 | A1 | 8/2013 |
| WO | WO-2013133787 | A1 | 9/2013 |

OTHER PUBLICATIONS

Extended Euopean Search Report dated Jan. 9, 2014 for corresponding EP Application No. 14156607.

* cited by examiner

*Primary Examiner* — Bernard Rojas
(74) *Attorney, Agent, or Firm* — Harness, Dickey & Pierce, P.L.C.

(57) ABSTRACT

A magnetic trip device of a thermal magnetic circuit breaker, a thermal magnetic circuit breaker that includes such a magnetic trip device, and a method for adjusting a magnetic field area of a magnetic trip device of a thermal magnetic circuit breaker, are disclosed. In an embodiment, the magnetic trip device includes at least an armature locator moveable arranged on a pin in order to adjust a magnetic field area, and an armature element fixed on a lower surface of the armature locator in order to interact with a yoke. The armature locator includes a stabilizer element in order to increase a contact area between the pin and the armature locator and/or a recess in order to receive at least an upper end of a spring element in order to space the armature element and the yoke from each other at least partially.

11 Claims, 5 Drawing Sheets

MAGNETIC TRIP DEVICE OF A THERMAL MAGNETIC CIRCUIT BREAKER HAVING A STABILIZER ELEMENT

PRIORITY STATEMENT

The present application hereby claims priority under 35 U.S.C. §119 to European patent application number EP 14156607.5 filed Feb. 25, 2014, the entire contents of which are hereby incorporated herein by reference.

FIELD

At least one embodiment of the present invention is generally directed to a magnetic trip device of a thermal magnetic circuit breaker, wherein the magnetic trip device has at least an armature locator moveable arranged on a pin in order to adjust a magnetic field area, and an armature element fixed on a lower surface of said armature locator in order to interact with a yoke, which is arranged near a current conductive element for conducting electric energy. Furthermore, at least one embodiment of the present invention is generally directed to a thermal magnetic circuit breaker having a magnetic trip device like mentioned above and/or a method for adjusting a magnetic field area of this magnetic trip device.

BACKGROUND

Essentially it is known that an thermal magnetic circuit breaker is a manually or automatically operated electrical switch designed to protect an electrical circuit from damage caused by overload or short circuit. Its basic function is to detect a fault condition and interrupt current flow. Therefore the thermal magnetic circuit breaker has for example at least one magnetic trip device in order to prevent the electrical circuit or an electrical device from damage by short circuit and a thermal trip device in order to prevent the electric circuit or an electrical device from damage by overload. A short circuit is an abnormal connection between two nodes of the electric circuit intended to be at different voltages. And especially in reference to a molded-case circuit breaker, a short-circuit is an abnormal connection between two separate phases, which are intended to be isolated or insulated from each other. This results in an excessive electric current, named an overcurrent limited only by the Thévenin equivalent resistance of the rest of the network and potentially causes circuit damage, overheating, fire or explosion. An overload is a less extreme condition but a longer-term over-current condition as a short circuit.

The magnetic trip device has at least an armature element moveable arranged with respect to a yoke or especially a current conduction element conducting electrical energy or current, respectively. The armature element or armature, respectively, is a magnetic element and especially a pole piece having at least partially an iron material and reacting to a magnetic field created by the yoke during a trip moment. In order to realize a guided movement of the armature element towards the yoke at least during a trip event like a short circuit, the armature element is arranged on an armature locator. The armature locator is moveable arranged on a pin extending from an adjustment bar towards the yoke. The armature locator or the adjustment bar can be connected with a trip bar which is able to interrupt a current flow of the current circuit, when the trip bar is moved due to a movement of the armature locator or the adjustment bar in conjunction with the armature element towards the yoke because of a magnetic force.

Disadvantageously, the armature locator oscillates on an axis of the pin during a presence of high current and therefore during the trip event is occurred. This oscillation can cause the armature locator to be in an angled or inclined position, which increases friction during movement and affecting the response time during the trip event. To minimize this behaviour, the length of a contact area of the armature locator around the pin needs to be sufficient. However, having a common adjustment of more than one armature locator requires utilization of a common adjustment bar, which limits available space and restricts size of this contact area.

Furthermore, a calibration spring arranged between the armature or the armature locator, respectively, and the yoke requires a minimum space to reach a solid height. In the magnetic trip unit the working position of this calibration spring and the required forces at those positions define the calibration spring dimensions. That means that the solid spring height resulting from the calibration spring design is a restriction that must be taken into account, because armature locator movement could be stopped when the spring reaches its solid state and is therefore totally compressed.

SUMMARY

At least one embodiment of the present invention is directed to a magnetic trip device, a thermal magnetic circuit breaker and/or a method for adjusting a magnetic field area of a magnetic trip device. Further features and details of the invention are subject of the sub claims and/or emerge from the description and the figures. Features and details discussed with respect to the magnetic trip device can also be applied to the thermal magnetic circuit breaker or the method for adjusting a magnetic field area of a magnetic trip device, respectively, and vice versa.

At least one embodiment of the present invention is directed to a thermal magnetic circuit breaker and especially a magnetic trip device of a thermal magnetic circuit breaker which allows in an easy and cost-effective manner a movement of the armature locator and therefore of the armature arranged on the armature locator towards the yoke during a trip event, wherein an oscillation movement is reduced and a response time and a displacement of the armature locator toward the yoke is improved. Therefore, the variance in the resulting current level required to initiate movement during a trip event should be reduced.

Further, at least one embodiment of the present invention is directed to a thermal magnetic circuit breaker and especially a magnetic trip device of a thermal magnetic circuit breaker by which a distance between the yoke and the armature locator is adjustable in an easy manner, advantageously practicable by an user or customizer, respectively. Furthermore, at least one embodiment of the present invention enables a movement of an armature locator of a magnetic trip device of a thermal magnetic circuit breaker towards the yoke without limitation caused by the calibration spring and especially the solid state of the calibration spring.

Furthermore, a method for adjusting a magnetic field area of a magnetic trip device of a thermal magnetic circuit breaker at least during an implementation process of the magnetic trip device is disclosed in at least one embodiment. The method has at least the following step:

pushing an adjustment bar horizontally along an upper surface of an armature locator, wherein an inclined protrusion of the adjustment bar, which is in contact with a surface of an inclined sliding area of the armature locator, slides along the surface of the sliding area in order to raise or lower the armature locator and the armature element arranged on a lower surface of the armature locator towards or from a yoke.

BRIEF DESCRIPTION OF THE DRAWINGS

Embodiments of an armature locator of a magnetic trip device and also an embodiment of a magnetic trip device according to the invention will be explained in more detail with reference to the accompanying drawings. The drawings show schematically in.

Figure 1:
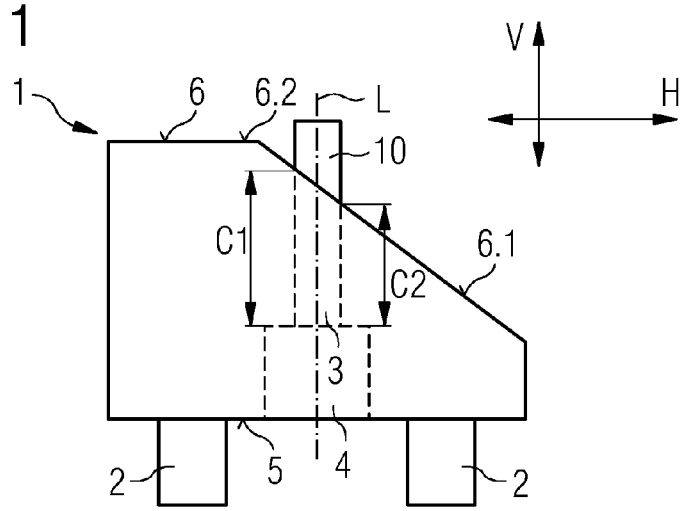
FIG. 1: a side view of a first embodiment of an armature locator of a magnetic trip device.

Elements having the same function and mode of action are provided in FIGS. 1 to 8 with the same reference signs.

DETAILED DESCRIPTION OF THE EXAMPLE EMBODIMENTS

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Before discussing example embodiments in more detail, it is noted that some example embodiments are described as processes or methods depicted as flowcharts. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Methods discussed below, some of which are illustrated by the flow charts, may be implemented by hardware, software, firmware, middleware, microcode, hardware description languages, or any combination thereof. When implemented in software, firmware, middleware or microcode, the program code or code segments to perform the necessary tasks will be stored in a machine or computer readable medium such as a storage medium or non-transitory computer readable medium. A processor(s) will perform the necessary tasks.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Portions of the example embodiments and corresponding detailed description may be presented in terms of software, or algorithms and symbolic representations of operation on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

In the following description, illustrative embodiments may be described with reference to acts and symbolic representations of operations (e.g., in the form of flowcharts) that may be implemented as program modules or functional processes include routines, programs, objects, components, data structures, etc., that perform particular tasks or implement particular abstract data types and may be implemented using existing hardware at existing network elements. Such existing hardware may include one or more Central Processing Units (CPUs), digital signal processors (DSPs), application-specific-integrated-circuits, field programmable gate arrays (FPGAs) computers or the like.

Note also that the software implemented aspects of the example embodiments may be typically encoded on some form of program storage medium or implemented over some type of transmission medium. The program storage medium (e.g., non-transitory storage medium) may be magnetic (e.g., a floppy disk or a hard drive) or optical (e.g., a compact disk read only memory, or "CD ROM"), and may be read only or random access. Similarly, the transmission medium may be twisted wire pairs, coaxial cable, optical fiber, or some other suitable transmission medium known to the art. The example embodiments not limited by these aspects of any given implementation.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" of "displaying" or the like, refer to the action and processes of a computer system, or similar electronic computing device/hardware, that manipulates and transforms data represented as physical, electronic quantities within the computer system's registers and memories into other data similarly represented as physical quantities within the computer system memories or registers or other such information storage, transmission or display devices.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

At least one embodiment of the present invention is directed to a thermal magnetic circuit breaker and especially a magnetic trip device of a thermal magnetic circuit breaker which allows in an easy and cost-effective manner a movement of the armature locator and therefore of the armature arranged on the armature locator towards the yoke during a trip event, wherein an oscillation movement is reduced and a response time and a displacement of the armature locator toward the yoke is improved. Therefore, the variance in the resulting current level required to initiate movement during a trip event should be reduced.

Further, at least one embodiment of the present invention is directed to a thermal magnetic circuit breaker and especially a magnetic trip device of a thermal magnetic circuit breaker by which a distance between the yoke and the armature locator is adjustable in an easy manner, advantageously practicable by an user or customizer, respectively. Furthermore, at least one embodiment of the present invention enables a movement of an armature locator of a magnetic trip device of a thermal magnetic circuit breaker towards the yoke without limitation caused by the calibration spring and especially the solid state of the calibration spring.

The magnetic trip device of a thermal magnetic circuit breaker has at least an armature locator moveable arranged on a pin in order to adjust a magnetic field area, and an armature element fixed on a lower surface of the armature locator in order to interact with a yoke, which is arranged near a current conductive element for conducting electric energy. According to at least one embodiment of the present invention the armature locator has for example a stabilizer element arranged on an upper surface of the armature locator in order to increase a contact area between the pin and the armature locator. Furthermore, it is conceivable alternatively or additionally that the magnetic trip device has a recess reaching from the lower surface inwards the armature locator in order to receive at least an upper end of a spring element surrounding at least a part of the pin between the armature element and the yoke in order to space the armature element and the yoke from each other at least partially.

Advantageously, the armature locator of the magnetic trip device has an armature locator design which is able to adjust a distance between the yoke and the armature element or the armature locator, respectively, in an easy manner for example by a costumer or an end user. A stabilizer element is additional arranged on an upper area or surface, respectively, of the armature locater, wherein the upper surface is a surface opposite the lower surface and therefore aligned in a direction away from the yoke and towards the adjustment bar.

The adjustment bar is used to adjust the distance mentioned above and especially an area of the magnetic field according to the customers concern. That means that the distance between the armature element and the yoke is reduced, when the costumer wishes an early interruption of the current circuit triggered by a short circuit of a low current. Therefore, the adjustment bar is moveable connected with the upper surface and especially with an area of the upper surface. Advantageously, the upper surface is at least partially inclined. Therefore, one area of the perimeter of the pin extending in the longitudinal direction of the pin is in contact with a wall of a through-hole of the armature locator more than another area of the perimeter of the pin which extends for example on the opposite of the perimeter of the pin. Basing on the different sizes of the contact areas, the armature locator oscillates around the pin at least during a movement of the armature locator toward the yoke. Therefore, a stabilizer element is arranged at least on one area of the upper surface of the armature locator in order to increase the contact area or contact zone, respectively, between the pin and the wall of the through-hole of the armature locator.

When the trip event like a short circuit occurs, a magnetic field is made in the magnetic field area between the yoke and the armature element. Advantageously, the armature element and the yoke have a steel material. Therefore, a magnetic force of attraction between the armature and the yoke is created by a magnetic flux passing through these parts. By means of the magnetic force of the magnetic field, the armature and therefore also the armature locator are pulled toward the yokes and away from the adjustment bar. The yoke is fixed on a base and especially in an area of a current conductive element, wherein the armature element moves towards the yoke, when the magnetic force overcomes the spring load of the spring element which is for example a calibration spring. When for example the armature element reaches a distance of circa 2.7 mm away from the yoke, the armature locator attached to the armature element starts pushing a trip bar. When the armature element reaches for example a distance of circa 0.5 mm away from the yoke, the armature locator already pushed the trip bar to its final position, where the energy storage is released. Once the energy storage is released, it strikes the main mechanism and the thermal magnetic circuit breaker changes to a trip position breaking the current path of the current circuit.

Advantageously, the yoke has at least two layers, namely an inner layer and an outer layer or an inner yoke and an outer yoke, respectively. The total thickness of both layers of the yoke is required to obtain the magnetic force.

Furthermore, it is possible that the armature locator has a recess or counterbore extending from the lower surface of the armature locator inwards the armature locator in direction to the upper surface of the armature locator. The lower surface extends at least partly parallel to a surface of the yoke. Advantageously, the recess has a diameter of for example circa 8 mm and a depth of for example circa 7 mm. The recess allows using a spring element resulting with a larger solid height without limiting an adjustment element displacement or stopping the armature locator. The spring element is for example a calibration spring and especially a compression spring.

By way of the adjustment bar, the distance between the armature element and the yoke and therefore the magnetic field area is for example set at circa 10 mm for release at ten times the nominal current (10×ln) and is for example set at circa 3.2 mm for release at five times the nominal current (5×ln). Advantageously, the customer or the end user, respectively, is able to set the magnetic trip device between any of these two points.

With respect to at least one embodiment of the present invention, it is thinkable that the stabilizer element is a wall extending away from the upper surface of the armature locator in longitudinal direction of the pin, wherein the stabilizer element surrounds the pin at least partially in a perimeter direction of the pin. Therefore, the stabilizer element surrounds the pin extending outside the armature locator at least at one side of its perimeter. Advantageously, the stabilizer element surrounds the perimeter of the pin extending outside the armature locator for example of more than 25% and preferably nearly 50%. An entirely surrounding of the perimeter of the pin by means of the stabilizer element about 100% in the additional contact zone or area, respectively, created by the stabilizer element is not realizable, because one side of the upper surface of the armature locator have to be contactable by a part of the adjustment bar. Therefore, advantageously the stabilizer element does not interfere with the movement of the adjustment bar.

It is conceivable that the magnetic trip device has an adjustment element which is arranged between the spring element and the yoke, wherein the adjustment element contacts a lower end of the spring element, in order to adjust a spring load of the spring element for example. Advantageously, the spring load of the spring element end especially of the calibration spring is adjustable by way of rotating the pin. That means when the pin rotates around its longitudinal axis, the adjustment element moves up or down, and as result, the spring load of the spring element is changed. The adjustment element is for example a calibration plate arranged on an upper surface of the yoke or an upper surface of a current conductive element arranged on the yoke. Advantageously, the adjustment of the spring load of the spring element is done at least in the production process of the magnetic trip device, wherein the adjustment element is fixed after a calibration process or test, respectively, in the production line.

In the context of at least one embodiment of the present invention, the pin has a threaded portion on which the adjustment element is located. This threaded portion is an external thread. Therefore, it is conceivable that the adjustment element has a recess and especially a through-hole with a threaded portion and especially an internal thread. The internal thread is moveable arranged on the external thread, wherein due to a rotation of the pin about its longitudinal axis the internal thread moves along the external thread in such a way that the adjustment element is moved up or down with respect to the yoke or the armature element and the armature locator, respectively.

Furthermore, it is conceivable that the adjustment element has at least one protrusion, which extends downwards into a recess of a current conductive element. Advantageously, the perimeter of the cross-section of the protrusion corresponds at least partially with the perimeter of the cross-section of the recess. That means that the width, the height and/or the length of the protrusion nearly correspond to the bright, the height and/or the length of the recess. The current conduction element is for example a current conduction line or an element which contacts the current conduction line in order to absorb thermal energy and/or electrical energy. It is also thinkable, that not the current conductive element has the recess, but the yoke, which contacts the current conductive element at least partially. Advantageously, the adjustment element has a non-conductive material or is coated with a non-conductive material.

By way of the protrusion, which is like a nose or a hook, a turning of the adjustment element is prevent. That means that during a turning of the pin around its longitudinal axis, the adjustment element arranged on the pin only moves up or down along the longitudinal axis of the pin and therefore in direction of the yoke or the current conductive element, respectively, or the armature element with the armature locator. Advantageously, the adjustment element is able to move along the longitudinal axis of the pin inside a range of for example circa 4 mm.

Furthermore, a thermal magnetic circuit breaker for protecting an electrical circuit from damage caused by overload or short circuit is disclosed in at least one embodiment. The thermal magnetic circuit breaker has at least a thermal trip device, which has a bimetallic element responding to longer-term over-current conditions and a magnetic trip device according to one embodiment and therefore according to a magnetic trip device mentioned above. Advantageously, the thermal magnetic circuit breaker, also named thermal magnetic trip unit (TMTU), has a translational magnetic system and especially a translational magnetic trip device with a common adjustment system like the adjustment bar for an instantaneous setting. Therefore, the adjustment is not done individually for each phase of the thermal magnetic circuit breaker.

Thus, it is conceivable that two or more magnetic trip devices are arranged at a common adjustment bar in order to adjust a magnetic field area of the magnetic drip devices at the same time. The adjustment bar has at least two or more than two protrusions extending from a lower surface of the adjustment bar in direction to the armature locator. Advantageously, the lower surface of these protrusions is inclined. The lower surface of these protrusions is able to contact the upper surface and especially an area of the upper surface of the armature locator, wherein the upper surface and especially the contact area of the upper surface of the armature locator is also inclined. Therefore, both the protrusions of the adjustment bar and the armature locator have inclined walls or surfaces, respectively, which contact each other.

Furthermore, a method for adjusting a magnetic field area of a magnetic trip device of a thermal magnetic circuit breaker at least during an implementation process of the magnetic trip device is disclosed in at least one embodiment. The method has at least the following step:

pushing an adjustment bar horizontally along an upper surface of an armature locator, wherein an inclined protrusion of the adjustment bar, which is in contact with a surface of an inclined sliding area of the armature locator, slides along the surface of the sliding area in order to raise or lower the armature locator and the armature element arranged on a lower surface of the armature locator towards or from a yoke.

The adjustment of the armature element and therefore of the armature locator and especially the calibration of the magnetic field area extending between the yoke and the armature element or between the current conductive element and the armature element, respectively, is preferably done by the end user during a field of application. Therefore the adjustment bar is moved manually by the end user. Advantageously, the end user rotates for example a knob that pushes the adjustment bar horizontally. Basing on the movement of the adjustment bar, the armature locator is moved in a vertical direction and especially in direction to the yoke which is preferably fixed inside the thermal magnetic circuit breaker. It is possible to move the adjustment bar within a range of circa 10 mm.

With respect to at least one embodiment of the present invention it is possible that during turning a pin around its longitudinal axis, an adjustment element arranged on a threaded portion of the pin and having a protrusion which extends in a recess of a current conductive element, is raised or lowered along the longitudinal axis of the pin. The pin extends from the adjustment bar through the armature locator and also through the armature element in direction to the yoke and the current conductive element arranged at the yoke. By way of turning the pin and raising or lowering the adjustment element which is for example a calibration plate, a magnetic field area extending between the yoke and the armature element or the current conductive element and the armature element, respectively, is changeable in order to adjust the reaction moment of the armature element with regard to the magnetizing force. The adjustment of this distance between the yoke and the armature element is preferably done in the factory for manufacture the magnetic trip device and especially for manufacture the thermal magnetic circuit breaker at least during a calibration test. Advantageously, the adjustment element is fixed after obtain conforming results of this calibration test.

Furthermore, it is conceivable that a spring element arranged between the armature element and the yoke is compressed or depressed due to the movement of the adjustment element along the pin or due to the movement of the armature locator along the pin. The spring element is for example a compression spring used to distance the armature element and therefore the armature locator arranged to the armature element from the yoke at least during no trip event occurs. The spring element has an upper end contacting the armature element and preferably the armature locator and a lower end contacting the adjustment element. So, it is possible that the spring element extends through the armature element and especially a through-hole of the armature element, wherein an upper end of the spring element is arranged inside a recess like mentioned above of the armature locator. Advantageously, same type of spring elements are useable for different types of magnetic trip devices, wherein preferably the depth of the recess of the armature locator can be vary.

FIG. 1 shows a side view of a first embodiment of an armature locator 1 having a lower surface 5 and an upper surface 6 opposite to the lower surface 5. At least one protrusion 2 or also more than one protrusion 2 extends away from the lower surface 5 in order to pick up for example a not shown armature element. Therefore, it is possible that the armature has at least one recess and preferably more than one recess in which the protrusion 2 can be brought in. The protrusion 2 can be a nose or a hook or such an element. Furthermore, the armature locator 1 has a through-hole 3 extending through the material of the armature locator 1 from the upper surface 6 to the lower surface 5 and therefore in a vertical direction V. Especially in an area near the lower surface 5, the through-hole 3 has a bigger perimeter than in the remaining part. This expending area of the through-hole 3 is a recess 4 or a counterbore 4 in order to pick up at least a part of a not shown spring element. Advantageously, by means of the recess 4 a secured arrangement of the spring element is realized. That means that a slipping away of the spring element can be prevented. Furthermore, a sufficiently dimensioned spring element can be used in the magnetic trip device without the risk of reaching a solid height or solid state, respectively, of a totally compressed spring element. That means that by means of the recess 4, the spring element has only a little prestressing after a calibration process by the operator in the production line or by the end user.

Also a pin 10 extending through the through-hole 3 and especially the recess 4 is schematically indicated in FIG. 1. The pin 10 has a longitudinal axis L which is at least partially centric to a longitudinal axis of the through-hole 3 and to a longitudinal axis of the recess 4. The upper surface 6 has an inclined sliding area 6.1 and a straight area 6.2. The inclined sliding area 6.1 extends from the straight area 6.2 in a defined angle in direction to the lower surface 5. Therefore, between the pin 10 and especially the wall of the pin 10 and the wall of the through-hole 3, different contact zones C1, C2 are present. One, namely the first contact zone C1 is bigger and especially larger than the other, namely the second contact zone C2. Basing on the different sizes of the contact zones C1 and C2, the armature locator 1 can be moved in an angled or inclined position, which increases friction during movement thus affecting the response time during a trip event.

Figure 2:
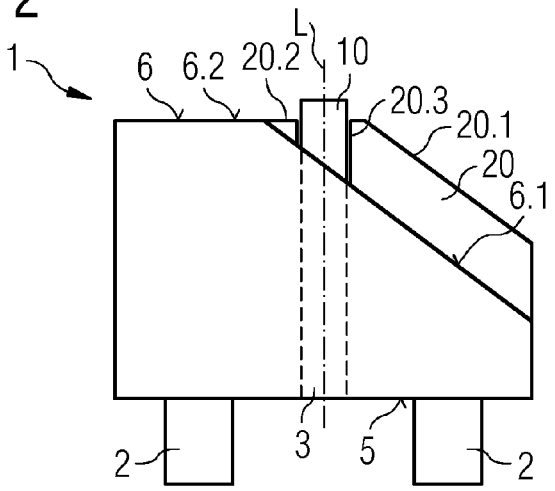
FIG. 2: a side view of a second embodiment of an armature locator of a magnetic trip device.

In order to overcome a large oscillation movement and a large inclination of armature locator 1 over the pin 10 axis L it is possible to arrange a stabilizer element 20 at least at one side of the pin 10 on the armature locator like shown in FIG. 2. Advantageously, the stabilizer element 20 extends away from the upper surface 6 of the armature locator 1 and is arranged especially at the inclined sliding area 6.1 of the upper surface 6. The stabilizer element 20 is preferably a wall, which has a recess or a groove (not shown) for guiding the pin 10 in longitudinal direction L. The stabilizer element 20 encloses the pin 10 at least partially and increases at least the second contact area C2, shown for example in FIG. 1 and advantageously the first contact zone C1 too, also shown in FIG. 1. Advantageously, the stabilizer element 20 generates an additional contact zone or contact area, respectively.

The second embodiment of the armature locator 1 shown in FIG. 2 differs from the first embodiment of the armature locator 1 shown in FIG. 1 also by a missing recess or counterbore, respectively. Therefore, disadvantageously the spring design and especially the solid height of a using spring element are limited.

Figure 3:
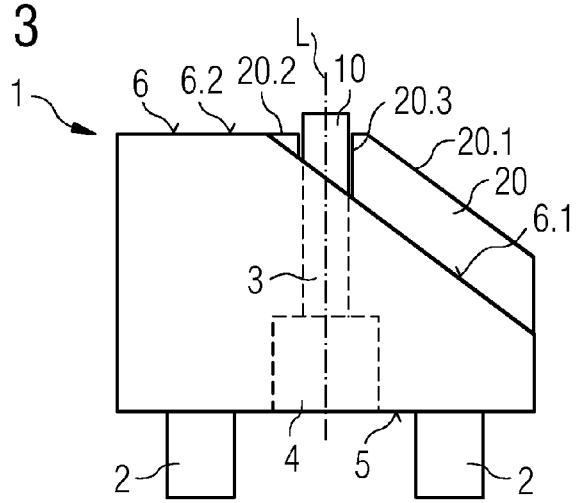
FIG. 3: a side view of a third embodiment of an armature locator of a magnetic trip device.

A third embodiment of an armature locator 1 having a recess 4 and also a stabilizer element 20 is shown in FIG. 3. Therefore, the third embodiment of the armature locator 1 combines the advantages of the first embodiment of the armature locator shown in FIG. 1 with the advantages of the second embodiment of the armature locator 1 shown in FIG. 2. With respect to a cost-effective production of an armature locator 1 it is possible to reduce the mass of material taken to realize the stabilizer element 20. So, it is conceivable to use a stabilizer element 20 which is only surrounding the hole, where the pin is passing through. A stabilizer element 20 which extends along the whole inclined sliding area 6.1 of the upper surface 6 is not required.

Figure 4:
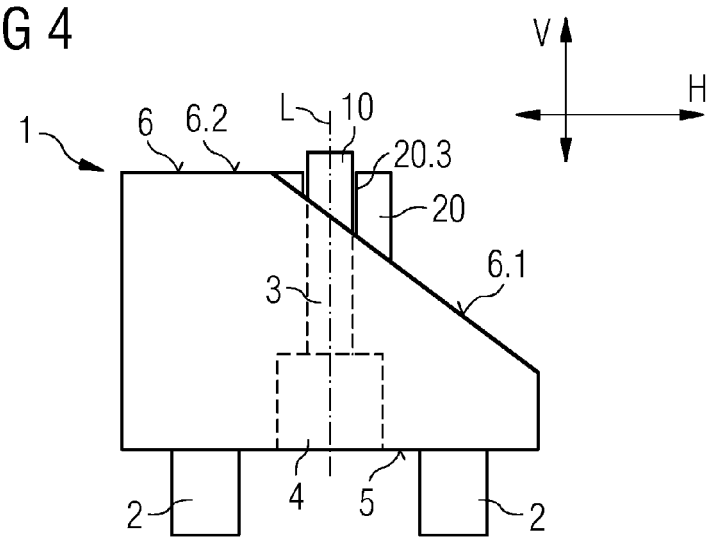
FIG. 4: a side view of a fourth embodiment of an armature locator of a magnetic trip device.

Therefore, a fourth embodiment of the armature locator 1 having a recess 4 and a stabilizer element 20 without excessive material is shown in FIG. 4. The stabilizer element 20 extends only partially on the inclined sliding area 6.1 of the upper surface 6 and increases the contact zones C1 and C2 in order to stabilize a movement of the armature locator in longitudinal direction L along the pin 10.

Figure 5:
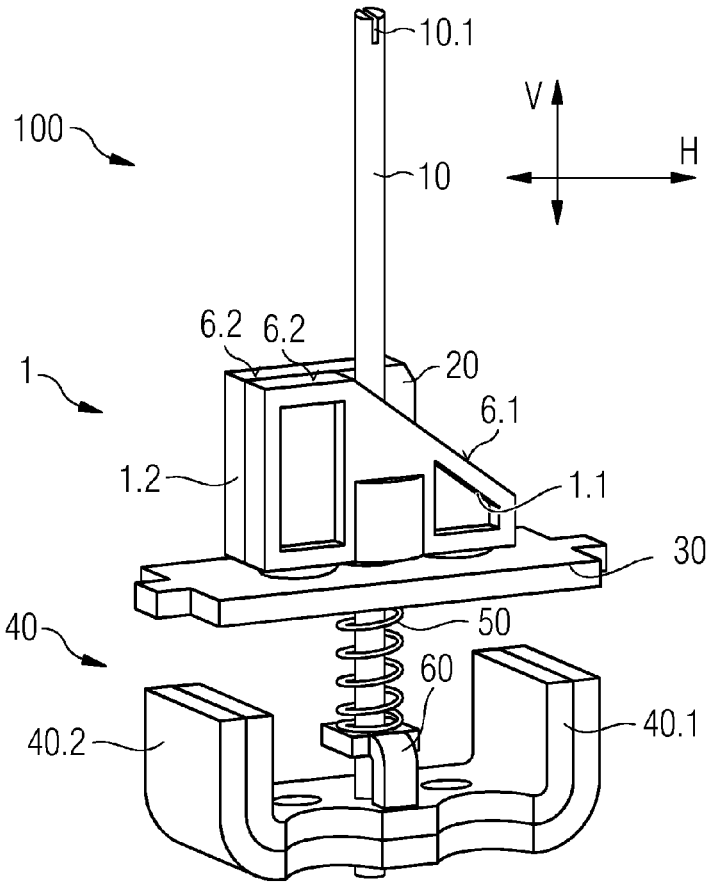
FIG. 5: a perspective view of an embodiment of a magnetic trip device having an armature locator according to FIG. 4, FIG. 6: a perspective view of an embodiment of a three pole arrangement with a common adjustment bar.

In FIG. 5 an embodiment of a magnetic trip device 100 is shown, wherein the magnetic trip device 100 has an armature locator 1 shown in FIG. 4. An armature element 30 is arranged on the lower surface 5 of the armature locator 1 and is fixed by the protrusions 2 of the armature locator 1. A spring element 50 is arranged between the armature element 30 and especially the armature locator 1 and a yoke 40. The yoke 40 has two layers, namely a first layer 40.1 and a second layer 40.2, wherein the first layer 40.1 is arranged on top of the second layer 40.2. The yoke 40 has a U-shape, wherein the legs of the U extend in direction to the armature element 30. The armature element 30 has a through-hole 30.1 for the spring element 50. The spring element 50 extends through the through-hole 30.1 in direction to the armature locator 1 and especially in direction to the lower surface 5 of the armature locator 1. Therefore, the spring element 50 has an upper end contacting the armature locator 1 and especially a wall off a recess 4 (cf. FIG. 5) of the armature locator 1, wherein a lower end of the spring element 50 contacts an adjustment element 60. The adjustment element 60 contacts at least partially the first layer 40.1 of the yoke 40 and has a protrusion 60.1 which is preferably fixed at least in the first layer 40.1 or in the first 40.1 and the second layer 40.2 of the yoke 40 or in a not shown current conduction element.

The armature locator 1 shown in FIG. 5 has two layers 1.1 and 1.2, which each extends in the longitudinal direction L and is fixed together in a contact area for contacting the pin 10. Both layers 1.1, 1.2 have an upper surface 6 having an inclined sliding area 6.1 and a straight area 6.2. A stabilizer element 20 is arranged only at one layer and according to FIG. 5 at the second layer 1.2 of the armature locator 1. Therefore, the sliding area 6.1 of the first layer 1.1 of the armature locator 1 is usable for sliding a protrusion or nose of an adjustment bar (shown in FIG. 6) on it. The stabilizer element 20 has a recess 20.3 or groove 20.3, respectively, in order to guide the pin 10 in a longitudinal direction L. Advantageously, the pin 10 is surrounded by means of the stabilizer element 20 at least partially. The pin 10 has a slot 10.1 at its upper end. By means of this slot 10.1 the pin is rotatable around its longitudinal axis L. Therefore, an intervention element like a knob or such an element is able to intervene into this slot 10.1 in order to interact with the pin 10.

Figure 6:
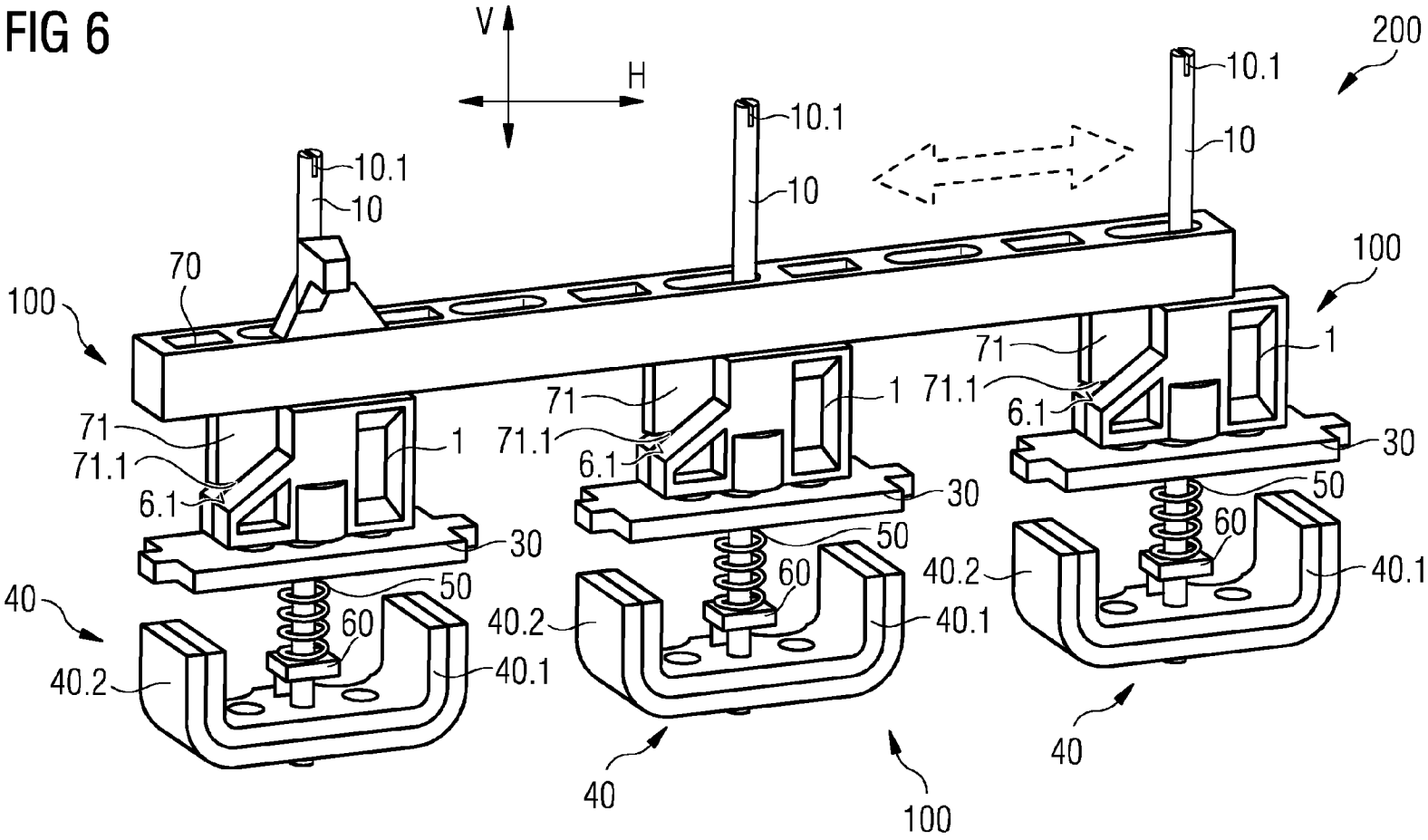

FIG. 6 shows a three pole arrangement 200 of the magnetic trip device 100 shown in FIG. 5. Therefore, the explanations about the magnetic trip device 100 shown in FIG. 5 are used as basement for the explanations of the arrangement of FIG. 6. The three pole arrangement 200 has three magnetic trip devices 100 arranged on a common adjustment bar 70. The adjustment bar 70 is usable to adjust the distance between the armature element 30 and the yoke 40 of each magnetic trip device 100 in a same time. The adjustment bar 70 is moveable in a horizontal direction H, shown with the arrow in FIG. 6. The protrusions 71 of the adjustment bar 70 contact the armature locator 1 and especially the inclined sliding area 6.1 of the upper surface 6 of the armature locator 1. Therefore, the protrusions 71 also have an inclined area 71.1 which contacts the inclined area 6.1 of the armature locator 1. Advantageously, the inclined area 71.1 or wall 71.1, respectively, of the protrusion 71 has a gradient with a defined angle, wherein the inclined area 6.1 or wall 6.1, respectively, of the armature locator 1 has a descent having a comparable angle.

Basing on the movement of the adjustment bar 70 the inclined area 71.1 of the protrusion 71 of the adjustment bar 70 is moved along the inclined area 6.1 of the armature locator 1, wherein the armature locator 1 is caused to move downwards in direction to the yoke 40 or upwards in direction to the adjustment bar 70. Therefore, a movement of the adjustment bar 70 in a horizontal direction H results in a movement of the armature locator 1 in a longitudinal direction L and especially in a vertical direction V.

Figure 7:
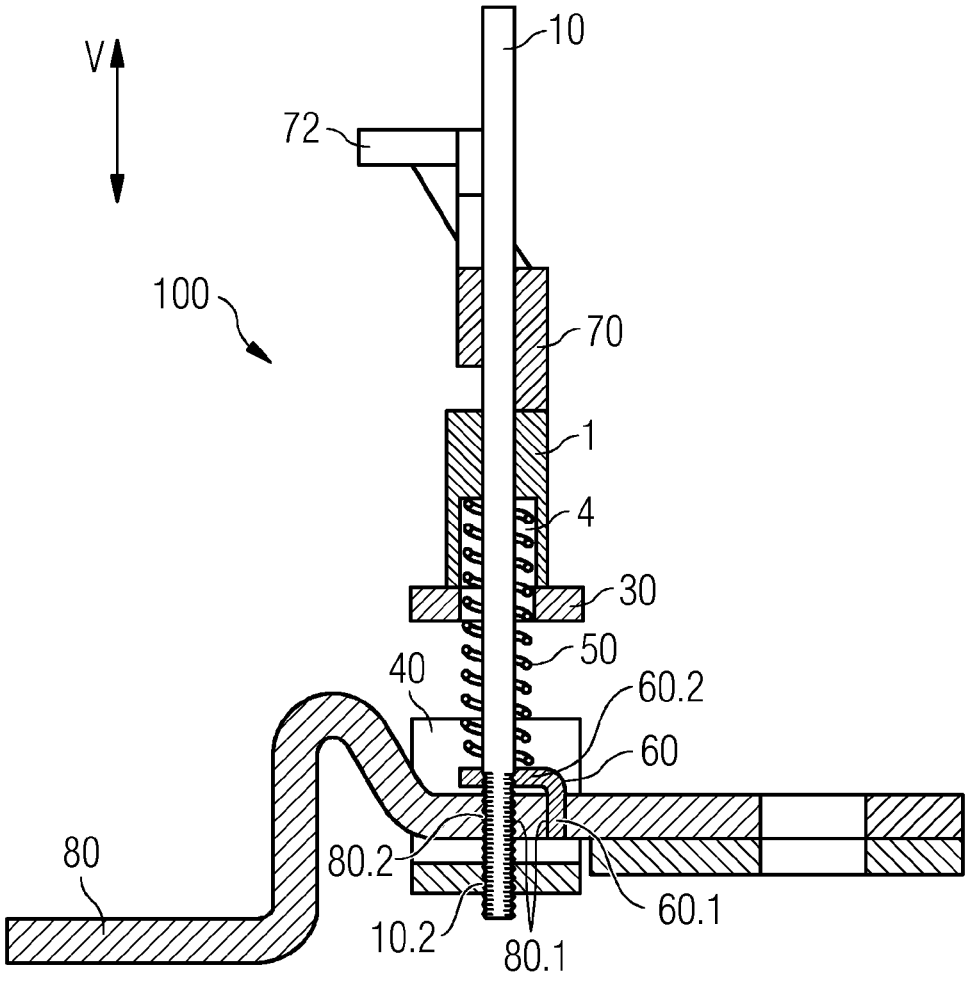
FIG. 7: a lateral sectioning of an embodiment of a magnetic trip device arranged on a current conductive element.

FIG. 7 shows a lateral sectioning of an embodiment of a magnetic trip device 100 contacting a current conductive element 80 extending essentially at least partially in a horizontal direction H along a lower plane of the magnetic trip device 100. The current conductive element 80 contacts the yoke 40 and especially its upper layer 40.1 or first layer 40.1, respectively. Therefore, the current conductive element 80 extends through the yoke 40 and essentially between the legs of the yoke 40 along the yoke 40. The current conductive element 80 for conducting an electrical current along an electrical path has a recess 80.1 which is formed like a hole or a bore for example. A protrusion 60.1 like a nose or a hook of the adjustment element 60 extends into this recess 80.1. The adjustment element 60 which is preferably designed like a calibration plate has a L-shape, wherein one leg of the L is the protrusion 60.1 and the other leg of the L is a holding plate 60.2 extending essentially at least partially parallel to a surface of the current conductive element 80 in the area of the yoke 40. The holding plate 60.2 is used to clamp the spring element 50 between the adjustment element 60 and the armature locator 1. It is conceivable, that the lower end of the spring element 50 contacting the adjustment element 60 is fixed with the adjustment element 60, wherein for example an end of the winding of the spring element extends into a holding element like a recess or such a thing of the adjustment element 60. Advantageously, the spring element 50 is removable arranged on or fixed with the adjustment element 60.

The pin 10 extends through the adjustment bar 70, through the armature locator 1 and through the armature 30 in direction to the yoke 40 and preferably through the yoke and therefore also through the current conductive element 80. The lower part of the pin has a threaded portion 10.2 and especially an external thread 10.2 which is moveable engaged with an internal thread 60.3 of the adjustment element 60 and also with an internal thread 80.2 of the current conductive element 80 and especially of a second clearance bore 80.3 or hole 80.3 of the current conductive element 80. It is also conceivable that the current conductive element 80 has only a clearance hole 80.3 without any thread and therefore without the internal thread 80.2 mentioned above.

The spring element 50 extends between the adjustment element 60 and the armature locator 1 and through the armature element 30 and especially through a bore or a through-hole 30.1 of the armature element 30. The spring element 50 surrounds the pin 10 and especially the perimeter of the pin 10 along a longitudinal axis of the pin 10. Advantageously, the upper end or an upper area, respectively, of the spring element 50 is arranged inside a recess 4 or a counterbore 4, respectively, of the armature locator 1. The spring element 50 has a defined spring load and spaces the armature 30 from the yoke 40, when no trip event like a short circuit occurs.

The adjustment bar 70 has a transfer element 72 extending in a horizontal direction away from the adjustment bar 70. By way of this transfer element 72, a movement of the adjustment bar 70 initiated by an end user or customer in a horizontal direction H in order to move the armature locator 1 in a vertical direction V is enabled. Basing on the movement of the armature element 30 in direction to the yoke 40 during a trip event, the armature locator 1 is moved in vertical direction V along the pin 10, wherein basing on this movement a trip bar is pushed to its final position, where the energy storage (also not shown in FIG. 7) is released.

Figure 8:
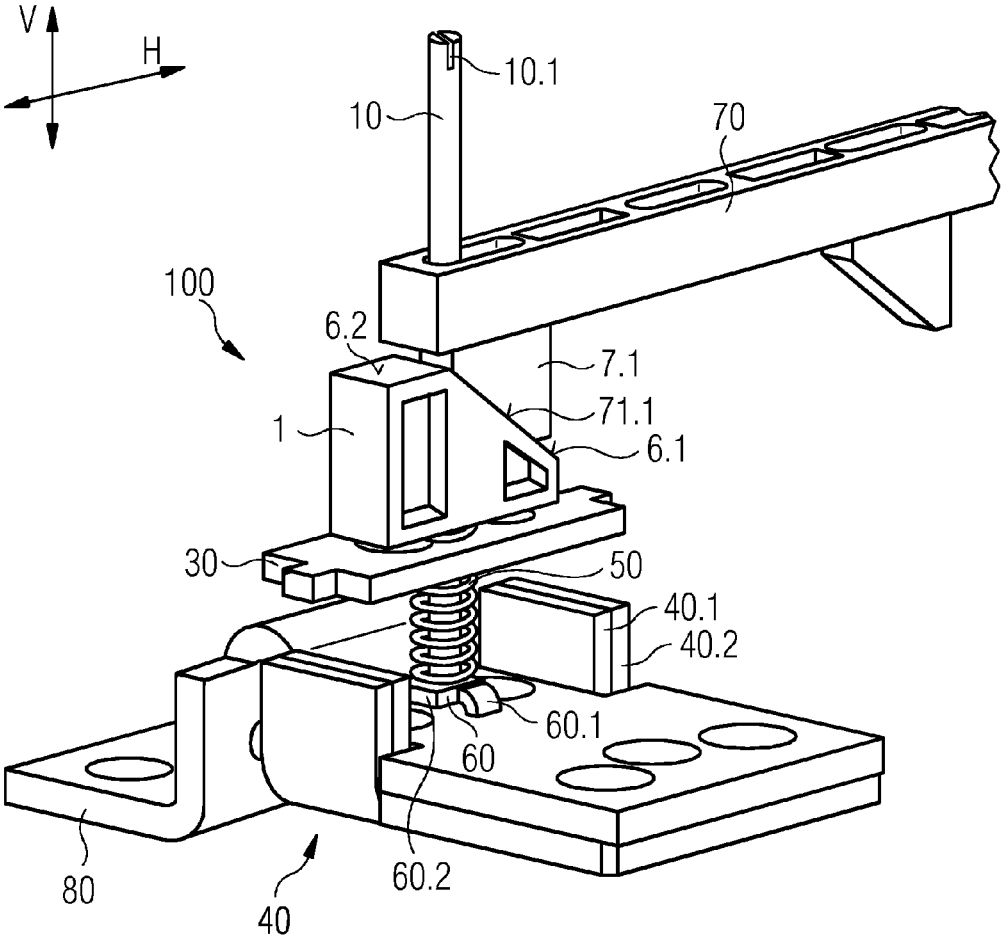
FIG. 8: a perspective view of the magnetic trip device shown in FIG. 7.

In FIG. 8 a perspective view of the magnetic trip device 100 pictured in FIG. 7 is shown, wherein especially the arrangement of the adjustment bar 70 and the armature locator 1 is clarified. When the adjustment bar 10 is moved in a horizontal direction H, for example in direction to the armature locator 1 (leftwards), the armature locator 1 is moved downwards in direction to the yoke 40. Basing on this movement the distance between the armature element 30 and the yoke 40 is reduced just like the magnetic field area extending at least partially between the yoke 40 and the armature element 30. The transformation of the horizontal movement of the adjustment bar 70 to a vertical movement of the armature locator 1 is done by means of both the inclined area or inclined surface, respectively, of the protrusion 71 of the adjustment bar 70 and the inclined area or surface, respectively, of the armature locator 1. Both inclined areas 71.1 and 6.1 contacts each other and are moveable arranged to each other in such a way, that the inclined areas 71.1 and 6.1 slide against each other. Therefore, during a horizontal movement of the adjustment bar 70 in direction away from the armature locator 1 (rightwards), the armature locator 1 is moved in vertical direction away from the yoke 40 (upwards), due to the spring load of the spring element 50. That means that the spring element 50 pushes back the armature locator 1. The adjustment bar 70 is only shown in sections in FIG. 8 and has preferably more than one protrusion 71 and especially two or three protrusions 71 in order to contact two or three single magnetic trip devices 100, for example as three pole arrangement 200 shown in FIG. 6.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Even further, any of the aforementioned methods may be embodied in the form of a program. The program may be stored on a tangible computer readable medium and is adapted to perform any one of the aforementioned methods when run on a computer device (a device including a processor). Thus, the tangible storage medium or tangible computer readable medium, is adapted to store information and is adapted to interact with a data processing facility or computer device to execute the program of any of the above mentioned embodiments and/or to perform the method of any of the above mentioned embodiments.

The tangible computer readable medium or tangible storage medium may be a built-in medium installed inside a computer device main body or a removable tangible medium arranged so that it can be separated from the computer device main body. Examples of the built-in tangible medium include, but are not limited to, rewriteable non-volatile memories, such as ROMs and flash memories, and hard disks. Examples of the removable tangible medium include, but are not limited to, optical storage media such as CD-ROMs and DVDs; magneto-optical storage media, such as MOs; magnetism storage media, including but not limited to floppy disks (trademark), cassette tapes, and removable hard disks; media with a built-in rewriteable non-volatile memory, including but not limited to memory cards; and media with a built-in ROM, including but not limited to ROM cassettes; etc. Furthermore, various information regarding stored images, for example, property information, may be stored in any other form, or it may be provided in other ways.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

REFERENCE SIGN LIST

1 armature locator
1.1 first wall of the armature locator
1.2 second wall of the armature locator
2 protrusion of the armature locator
3 through-hole of the armature locator
4 recess of the armature locator
5 lower surface of the armature locator
6 upper surface of the armature locator
6.1 inclined sliding area/surface of the upper surface
6.2 straight area/surface of the upper surface
10 pin
10.1 slot
10.2 thread/external thread
20 stabilizer element
20.1 inclined area of the stabilizer element
20.2 straight area of the stabilizer element
20.3 recess/groove of the stabilizer element
30 armature
30.1 through-hole of the armature
40 yoke
40.1 first layer of the yoke
40.2 second layer of the yoke
50 spring element
60 adjustment element
60.1 protrusion of the adjustment element
60.2 holding plate of the adjustment element
60.3 thread/internal thread of the adjustment element
70 adjustment bar
71 protrusion/nose of the adjustment bar
71.1 inclined area of the protrusion
71 transfer element of the adjustment bar
8 current conductive element
80.1 recess of the current conductive element
80.2 thread/internal thread of the current conductive Element
80.3 clearance bore/hole
100 magnetic trip device
200 three pole arrangement
C1 first contact zone
C2 second contact zone
H horizontal direction
L longitudinal axis/direction
V vertical direction

What is claimed is:

1. Magnetic trip device of a thermal magnetic circuit breaker, the magnetic trip device comprising:

an armature locator, moveably arranged on a pin, to adjust a magnetic field area; and an armature element, fixed on a lower surface of said armature locator, to interact with a yoke arranged near a current conductive element, for conducting electric energy, the armature locator, including at least one of a stabilizer element, arranged on an upper surface of the armature locator, to increase a contact area between the pin and the armature locator, and a recess in the armature locator, to receive at least an upper end of a spring element surrounding at least a part of the pin, wherein a portion of the spring element is between the armature element and the yoke.

2. Magnetic trip device of claim 1, wherein the stabilizer element is a wall extending away from the upper surface of the armature locator in longitudinal direction of the pin, and wherein the stabilizer element surrounds the pin at least partially in a perimeter direction of the pin.

3. Magnetic trip device of claim 1, wherein an adjustment element is arranged between the spring element and the yoke, and wherein the adjustment element contacts a lower end of the spring element.

4. Magnetic trip device of claim 3, wherein the pin includes a threaded portion on which the adjustment element is located.

5. Magnetic trip device of claim 3, wherein the adjustment element includes at least one protrusion, which extends downwards into a recess of the current conductive element.

6. Thermal magnetic circuit breaker for protecting an electrical circuit from damage caused by overload or short circuit, comprising:

a thermal trip device, including a bimetallic element responding to longer-term over-current conditions; and the magnetic trip device of claim 1.

7. Thermal magnetic circuit breaker of claim 6, wherein the thermal magnetic circuit breaker includes two or more of the magnetic trip devices, are arranged on a common adjustment bar, to adjust a magnetic field area of the magnetic drip devices at the same time.

8. Method for adjusting a magnetic field area of a magnetic trip device of a thermal magnetic circuit breaker at least during an implementation process of the magnetic trip device, comprising:

pushing an adjustment bar horizontally along an upper surface of an armature locator, wherein an inclined protrusion of the adjustment bar, in contact with a surface of an inclined sliding area of the armature locator, is configured to slide along the surface of the sliding area in order to raise or lower the armature locator and the armature element arranged on a lower surface of the armature locator towards or from a yoke.

9. Method of claim 8, wherein a pin is turning around its longitudinal axis, wherein an adjustment element arranged on a threaded portion of the pin and includes a protrusion, which extends in a recess of a current conductive element, is raised or lowered along the longitudinal axis of the pin.

10. Method of claim 8, wherein a spring element, arranged between the armature locator and the yoke, is compressed or depressed due to the movement of the adjustment element along the pin or due to the movement of the armature locator along the pin.

11. Magnetic trip device of claim 4, wherein the adjustment element includes at least one protrusion, which extends downwards into a recess of the current conductive element.

* * * * *